US005141412A

United States Patent [19]

Meinz

[11] Patent Number: 5,141,412

[45] Date of Patent: Aug. 25, 1992

[54] DOUBLE ACTING BELLOWS-TYPE PUMP

[76] Inventor: Hans W. Meinz, Kockerellstrasse 19, 5100 Aachen, Fed. Rep. of Germany

[21] Appl. No.: 671,855

[22] PCT Filed: Oct. 5, 1989

[86] PCT No.: PCT/DE89/00636

§ 371 Date: Apr. 8, 1991

§ 102(e) Date: Apr. 8, 1991

[87] PCT Pub. No.: WO90/04106

PCT Pub. Date: Apr. 19, 1990

[30] Foreign Application Priority Data

Oct. 6, 1988 [DE] Fed. Rep. of Germany ..... 3833973

[51] Int. Cl.[5] ..... F04B 43/00; F04B 45/02

[52] U.S. Cl. ..... 417/473; 92/37; 92/44

[58] Field of Search ..... 92/34, 37, 38, 44, 48; 417/393, 473

[56] References Cited

U.S. PATENT DOCUMENTS

| | | | |
|---|---|---|---|
| 1,546,706 | 7/1925 | Bezzenberger | 92/44 |
| 1,920,014 | 7/1933 | Horton et al. | 92/37 |
| 2,945,376 | 7/1960 | Gehre | 92/37 |
| 3,092,821 | 6/1963 | Muehlner | 92/44 |
| 3,182,597 | 5/1965 | Malizard et al. | 417/473 |
| 3,791,768 | 2/1974 | Wanner | 417/393 |
| 4,008,984 | 2/1977 | Scholle | 417/393 |
| 4,334,837 | 6/1982 | Inada et al. | 417/393 |

FOREIGN PATENT DOCUMENTS

| | | | |
|---|---|---|---|
| 9910 | 12/1853 | France | 417/473 |
| 489953 | 12/1954 | Italy | 417/473 |

*Primary Examiner*—Thomas E. Denion
*Attorney, Agent, or Firm*—Staas & Halsey

[57] ABSTRACT

A double acting, self-priming bellows-type pump has a pair of bellows that work as displacement elements arranged each in a cylinder chamber mutually and synchronously interlocked by piston rod, so that at the same time as one bellows draws in, the other bellows delivers. One side of each bellows receives the medium to be delivered and the other side receives a medium under pressure. In at least the lower cylinder the bellows is connected to the top wall of the cylinder chamber so that the space around the outside of the bellows may be used for pumping fluid. A guide element is mounted in the lower chamber for supporting the bellows of the lower chamber and preventing the same from buckling during the alternating pressurizing and venting thereof during a pumping cycle.

10 Claims, 3 Drawing Sheets

DOUBLE ACTING BELLOWS-TYPE PUMP

DESCRIPTION

The invention relates to a double acting, bellows-type pump for gases and/or fluids, in particular aggressive and/or abrasive media, with two cylinder chambers arranged one above the other which are each divided by a bellows, hermetically connected at one end to a head wall of the relevant cylinder chamber and at its other end closed by a base, into an outer chamber and an inner chamber enclosed by the corresponding bellows: such that the bellows bases are mechanically interlocked by a piston rod which runs through at least one seal of each cylinder chamber, so that simultaneously one bellows draws in and one bellows delivers, in that the chambers adjacent to the seal or seals are connected with intakes and outlets for a medium under pressure and that the chambers facing away from the seal or seals are connected with intakes and outlets for the medium to be delivered.

A double acting bellows-type pump of this kind is known from FR-PS 13 15 900, which is intended for continuous delivery or for increasing the pressure of a fluid. This known pump possesses two bellows arranged one above the other in one cylinder chamber each, which alternately perform one drawing and one pressure stroke, whereby the medium to be delivered is located inside the bellows and the driving medium under pressure is outside the bellows.

A disadvantage of this known pump is that in the case of the delivery of fluids, self-acting ventilation on the delivery medium side is fundamentally not possible with this arrangement of the bellows. However, self-acting ventilation is absolutely necessary for the delivery of most fluid media, as otherwise fault-free functioning of the pump is not guaranteed.

The task of the present invention consists in designing a double acting bellows-type pump in such a way that it automatically releases air during operations, so that the air released in the medium to be delivered can constantly escape, and that it can perform large strokes as well as having a high number of load alternations.

This task is solved in accordance with the invention by a pump of the kind mentioned at the beginning in that in the cylinder chambers either one inner chamber each, or in the lower cylinder chamber one inner chamber and in the upper cylinder chamber one outer chamber, communicate or communicates directly with the seal or seals, and that the bellows of the inner chambers or inner chamber directly communicating with the seal/seals are supported in these inner chambers or this inner chamber by at least one guide element each, arranged concentrically to the corresponding bellows, whereby the guide element is fixed to the head wall of the relevant cylinder chamber.

In order to achieve automatic ventilation of all inner and outer chambers it must be possible to arrange the intakes or outlets at the highest point of each bellows in each case. This is possible with the pump in accordance with the invention.

In contrast with the known pump, in accordance with the invention the bellows of which the inner chamber connects directly with the seal or seals is subjected to inner excess pressure. However, bellows subjected in this way to inner excess pressure—as opposed to bellows subjected to outer excess pressure according to the state of the art technology described above—are not proof against buckling, making them unsuitable for use in a pump. For this reason a centric guide free from play is absolutely necessary for the bellows subjected to inner excess pressure on the side of the medium to be delivered.

The supported bellows can be extremely thin-walled, i.e. very flexible and have a high number of load alternations.

When this type of flexible bellows is used, the stroke end positions in both directions should not be overstepped, so as to avoid destroying the bellows which are designed for slight differential pressure. Determination of the end positions may be by means of mechanical or electrical sensors as desired. These are in most cases also available in encapsulated high-pressure-resistant versions. As soon as a corresponding signal is received from the sensor, the compressed air or hydraulic current provided by the pressure unit is reversed by a 4/2-way valve. In this way an inadmissible increase in the differential pressure between pressure and delivery medium is prevented and the functions of pressure and drawing-in chambers reversed.

On the whole, the bellows-type pump in accordance with the invention can be designed as a simple pump construction which does not have the disadvantages of the known bellows-type pump, is simple to assemble, requires little maintenance and is capable of delivering highly abrasive as well as chemically agressive media, whereby the material valves which come into contact with the medium to be delivered are either self-acting nonreturn valves or forcibly controlled shutoff valves and control on the pressure medium side is by means of electrically, pneumatically or hydraulically operated 4/2-way valves.

Depending on the pressure necessary, the bellows can be driven by a central supply of pressurized air provided or by a central hydraulic system.

Where a larger number of pumps in accordance with the invention is in use, a cental hydraulic system with low-viscose hydraulic fluids is the most economic type of pressure supply, which can operate with centrifugal pumps up to extreme pressures and maximum delivery amounts in constant operation at high efficiency and with low plant costs. Correspondingly designed centrifugal pumps in continuous operation achieve service lives of approx. 50,000 hours before their first maintenance, which usually involves no more than changing a slide ring sealing.

For the operation of single pumps, small hydraulic units with pressure and/or volume control are recommended, unless the supply from an already available compressed air network is to be used.

The pump in accordance with the invention can further be designed in such a way that the bellows is supported by at least one support ring on at least one guide element. Because of the support rings, the bellows are not subject to any wear, as the support rings, supported on one or more guide elements, take up the wear.

The pump in accordance with the invention can further be designed in such a way that the support ring is slotted and fixed in a self-tightening manner to at least one fold of the relevant bellows and that the guide element consists of a cylindrical tube which is slotted or perforated at least once in a longitudinal direction. The slotted support ring is particularly easy to manufacture and cannot be lost after being fitted. The guide element can be particulaly easily manufactured from a cylindrical tube provided with slots or perforations distributed around its circumference, in order to prevent a build-up of pressure between the support rings.

The pump in accordance with the invention can further be designed in such a way that the intake and discharge of the medium under pressure of the inner chamber in the upper cylinder chamber take place by means of a hollow drilled piston rod, whereby the connection through the hollow piston rod to the inner chamber is provided by an axial borehole and by radial boreholes at the highest point of the inner chamber as well as between the two seals. This arrangement is a simple way of ensuring automatic ventilation even when one inner chamber in each cylinder chamber is directly adjacent to the seal or seals.

The pump in accordance with the invention can further be designed in such a way that the bellows consist of at least two dividing walls adjacent to one another. A double or multi-wall design of the bellows allows a high degree of elasticity with simultaneous large bending resistance (principle of flat spring), resulting in a greater effective displacement volume of the bellows. A further advantage of a multi-layer bellows, in particular in the case of a steel bellows, is the greater safety when leaks develop. As a rule not all dividing walls develop leaks at the same time, instead a leak begins at an outer dividing wall.

The pump in accordance with the invention can further be designed in such a way that the intermediate space or spaces between the dividing walls communicates or communicate with the surroundings outside the cylinder chambers, whereby the intermediate space or spaces serves or serve as a channel for a leakage indicator in the case of a rupture of the bellows. If the bellows ruptures, either the medium under pressure or the medium to be delivered enters the intermediate space or spaces between the dividing walls and from there reaches the outside where it either triggers an alarm or stops the pump. At any rate the leakage indication is given before any mixing of the medium under pressure and the medium to be delivered can occur.

The pump in accordance with the invention can further be designed in such a way that an inert liquid film is provided between the dividing walls of the bellows which transmits the leakage indication to the outside in the case of a rupture of the bellows.

An inert liquid film of this type, which is connected with the surroundings outside the pump housing, allows a very rapid reaction in the case of a rupture of a wall of the bellows, so that a leakage indication is possible long before the bellows as a whole becomes leaky.

The pump in accordance with the invention can further be designed in such a way that a hydraulic accumulator which equalizes the pulsation present in the delivery stream is provided at the pump outlet. Although the pulsations caused by the reversal of the stroke are considerably smaller than those arising in comparable piston pumps because of the extreme lightness of the masses moved, they must, however, for most applications be reduced still further.

The pump in accordance with the invention can further be designed in such a way that the hydraulic accumulator consists of a bellows located in one cylinder chamber, which is hermetically connected at one end with a head wall of the cylinder chamber and is closed at its other end with a base and that the cylinder chamber is divided into an inner chamber enclosed by the bellows and an outer chamber, whereby the inner or outer chamber is filled with an inert pressure gas and the outer or inner chamber is filled with the medium to be delivered. Thus, a bellows with a base is permanently fitted in a cylindrical pressure vessel on the vessel lid, whereby the bellows can oscillate without contact and thus equalize fluctuations in the delivery flow. This bellows-type hydraulic accumulator has the same advantages as the bellows pump and is particularly suitable for agressive, abrasive media which cause service life problems for membrane-type hydraulic accumulators with plastic membranes.

In the following part of the description, two practical embodiments of the pump in accordance with the invention are shown with the aid of drawings and subsequently described in more detail:

Figure 1:
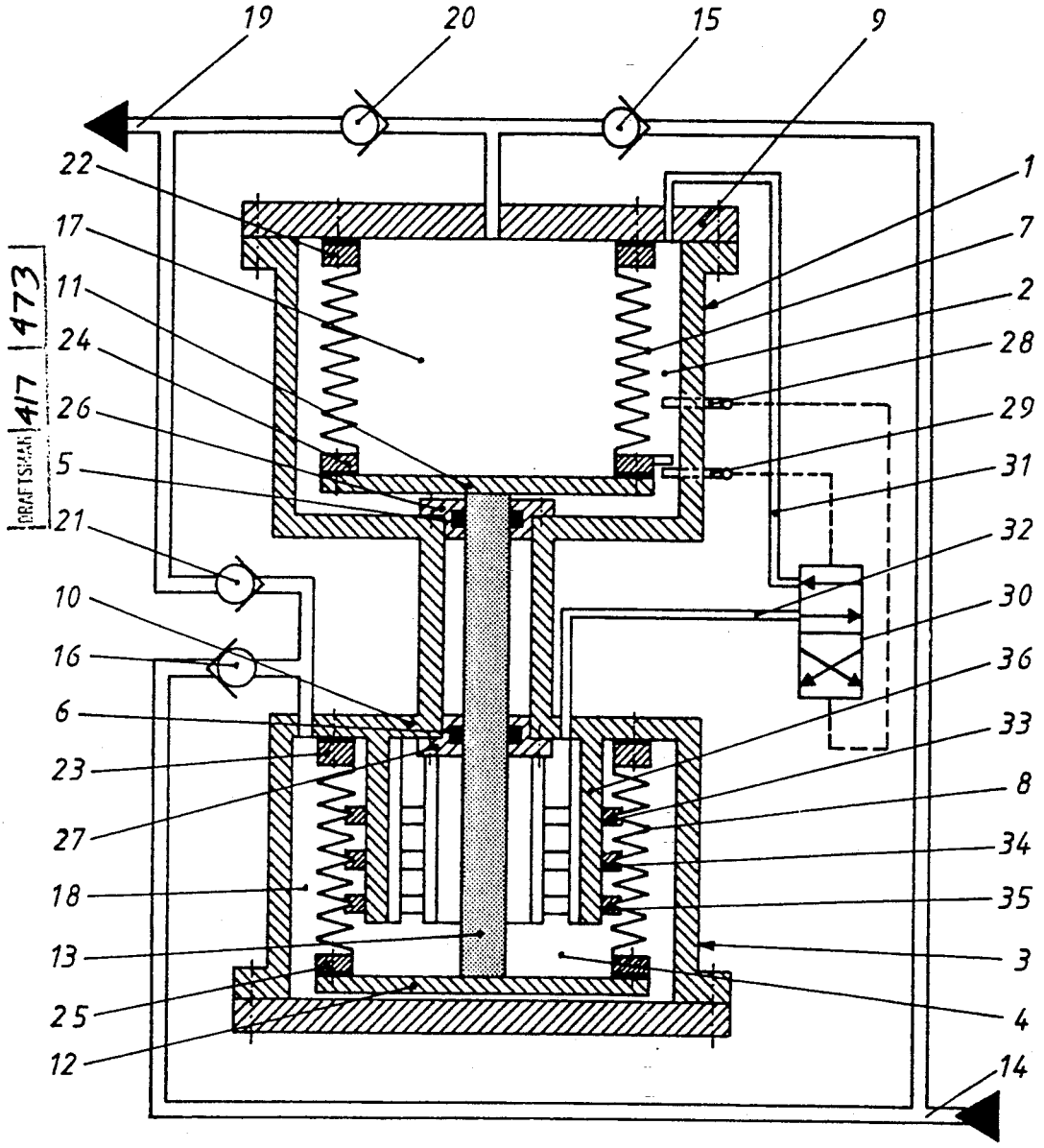
FIG. 1 shows a pump in which one outer chamber in the upper cylinder chamber and one inner chamber in the lower cylinder chamber are connected directly with the seals.

FIG. 1 shows a pump where in the upper cylinder chamber 1 an outer chamber 2 and in the lower cylinder chamber 3 an inner chamber 4 are connected directly to the seals 5, 6. The two bellows 7, 8 are each hermetically joined to a head wall 9, 10 of the corresponding cylinder chamber 1, 3 and closed at their other end by a base 11, 12. The bases 11, 12 are in turn permanently connected to one another by a piston rod 13 which runs through the seals 5, 6, so that the two bellows 7, 8 are both simultaneously at their stroke end positions. The pump also possesses a suction line 14 for the medium to be delivered which is connected with an upper inner chamber 17 and a lower outer chamber 18 via one self-acting nonreturn valve 15, 16 each. The pump is also provided with a pressure line 19 for the medium to be delivered which is also connected with the upper inner chamber 17 and the lower outer chamber 18 via one self-acting nonreturn valve 20, 21 each.

The bellows 7, 8 are fixed with screws to the head walls 9, 10 via flanges 22, 23, and to the bases 11, 12 via flanges 24, 25. Where steel bellows are used the flanges 24, 25 will usually be replaced by a welded construction.

The piston rod 13, which is only subjected to traction force originating from the suction force of the pump, is of correspondingly light construction and mounted in two piston rod guides 26, 27 and sealed in each case by one of the seals 5, 6 between the upper outer chamber 2 and the lower inner chamber 4. It is essential for the service life of the bellows 7, 8 which are designed for low differential pressure, that the pressure level between the inner chambers 4, 17 and the outer chambers 2, 18 of the two bellows 7, 8 is almost equal under all operating conditions of the pump. In particular, care must be taken that at the stroke end points the differential pressure between the inner chambers 4, 17 and the outer chambers 2, 18 of the bellows 7, 8 does not increase too far. Structurally, this requirement can be realized by the use of electrical, pneumatic or hydraulic control elements 28, 29, which in this case are mechanically activated by the bellows base 11 so as to switch over a 4/2-way valve 30 which supplies the upper outer chamber 2 and the lower inner chamber 4 with a medium under pressure via one intake or outlet line 31, 32 each. The control elements 28, 29 thus prevent movement of the bellows 7, 8 over and above the stroke permitted and thus also inadmissably high differential pressures between the inner chambers 4, 17 and the outer chambers 2, 18 of the bellows 7, 8 at the stroke end points. At the same time the control elements 28, 29 control reversal of the direction of movement and thus the exchange of the drawing and delivering functions of the two bellows 7, 8.

Figure 3A:
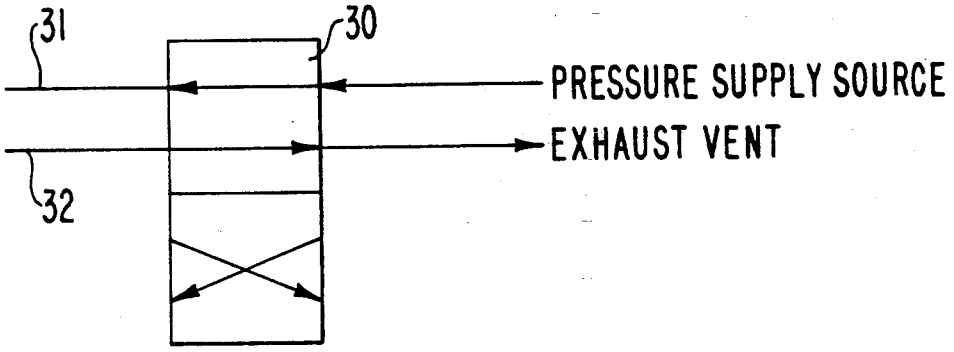
FIGS. 3A and 3B are schematic views illustrating the operation of the valve 30 of FIGS. 1 and 2.
Figure 3B:
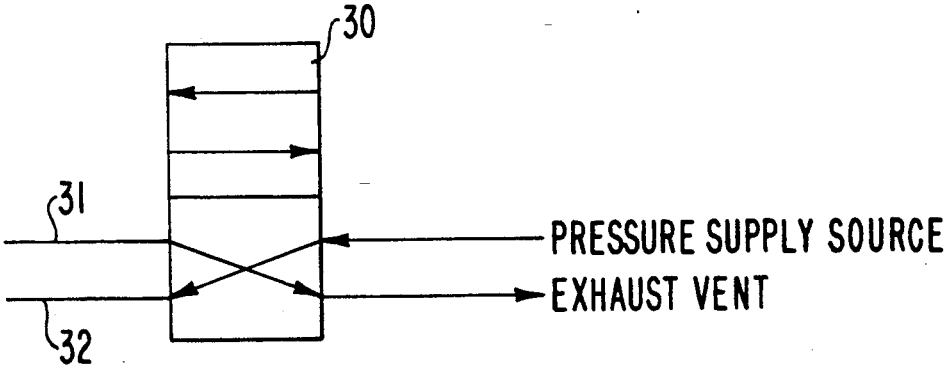

The operation of the valve 30 is illustrated in FIGS. 3A and 3B. When the valve is in its lower position as shown in FIGS. 1 and 3A, pressure is supplied from the pressure supply source through line 31 to the outer chamber 2 of the upper cylinder so that the plate 11 is forced upwardly to deliver fluid from inner chamber 17 to line 19. At the same time the inner chamber 4 of the lower cylinder is vented through line 32 to the exhaust vent to facilitate movement of plate 12 upwardly by piston rod 13. The upward movement of plate 12 draws fluid to be delivered into the outer chamber 18 of the lower cylinder from the supply line 14. On the other hand, when valve 30 is in its upper position as illustrated in FIG. 3B, inner chamber 4 is pressurized from the pressure supply source through line 32 while outer chamber 2 of the upper chamber is vented through line 31 to the exhaust vent. This causes plate 12 to be pushed downwardly to deliver medium in chamber 18 to line 19 while plate 11 is moved downwardly to cause the medium to be delivered to be drawn into inner chamber 17 of the upper cylinder from supply line 14.

The bellows 8 in the lower cylinder chamber 3 is under inner excess pressure. It is guided by three split support rings 33, 34, 35 which are each placed radially from the inside on one fold of the bellows 8, on a guide element 36 arranged concentrically to the bellows 8 and fixed onto the head wall 10 of the lower cylinder chamber 3. In this practical embodiment, the guide element 36 consists of a cylindrical tube slotted four times which prevents a pressure build-up of the medium under pressure between the support rings.

Figure 2:
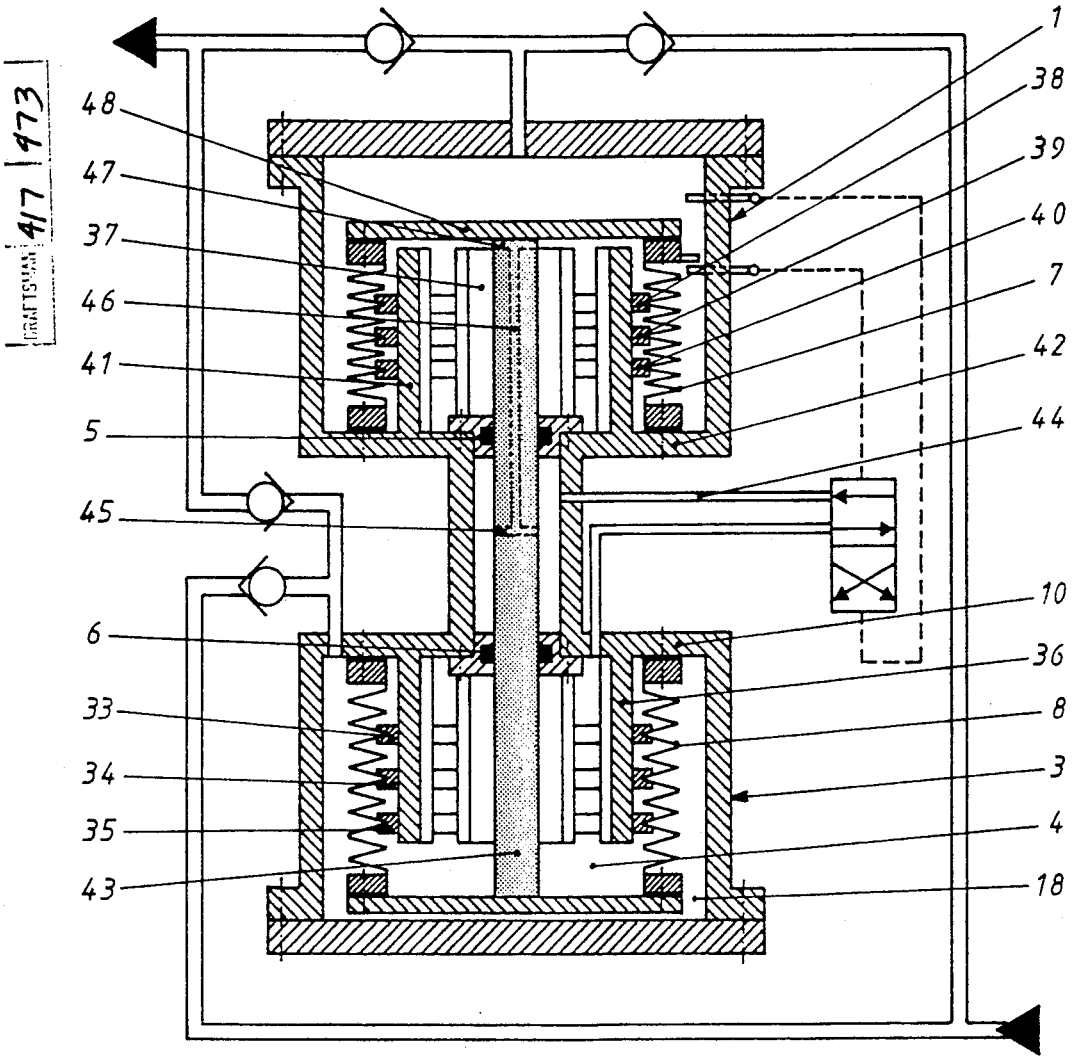
FIG. 2 shows a pump in which one inner chamber in both cylinder chambers is connected directly with the seals.

FIG. 2 shows a pump in which one inner chamber 4, 37 in each of the two cylinder chambers 1, 3 is directly connected with the seals 5, 6. This practical embodiment is structurally slightly more complex than the above-described, as here both bellows 7, 8 are subject to inner overpressure and thus principally in danger of buckling. In order to avert this danger, both bellows 7, 8 are provided with the support rings 33, 34, 35, 38, 39, 40 as well as with the corresponding guide elements 36, 41, which are each fixed to the head wall 10, 42.

In addition a hollow drilled piston rod 43 is provided, as the medium under pressure in the bellows 7 in the upper cylinder chamber 1 must be discharged or drawn in via the intake or outlet line 44 through the boreholes 45, 46, 47 in the piston rod 43, in order to allow automatic ventilation at the level of the bellows base 48.

I claim:

1. A double acting bellows pump comprising:

an upper chamber having an upper wall and a lower wall, said walls of the upper chamber being disposed in facing relationship and being spaced apart so as to define a first hollow interior space therebetween;

a lower chamber having an upper wall and a lower wall, said walls of the lower chamber being disposed in facing relationship and being spaced apart so as to define a second hollow interior spaced therebetween, said upper chamber being positioned above the lower chamber with said lower wall of the upper chamber facing the upper wall of the lower chamber;

an elongated piston rod extending through the upper wall of the lower chamber and through the lower wall of the upper chamber, said rod having a first end disposed in said first space and a second end disposed in said second space, said piston rod being mounted for longitudinal reciprocation;

a first base plate mounted at said first end of the rod;

a second base plate mounted at said second end of the rod;

a first bellows in said upper chamber, said first bellows having one end hermetically connected to the first base plate and another end hermetically connected to one of the walls of the chamber so as to divide the first space into inner and outer portions;

a second bellows in said lower chamber, said second bellows having one end hermetically connected to the second base plate and another end hermetically connected to the upper wall of the lower chamber so as to divide the second space into inner and outer portions;

a medium delivery piping system having intake and outlet lines for the medium to be delivered, said system including a first line which communicates with one of the portions of the first space and a second line which communicates with the outer portion of the second space, the arrangement being such that one of the bellows draws in and the other bellows delivers with each stroke of the piston rod;

a pressurized fluid supply system for driving said piston rod, said pressurized fluid supply system having a third line which communicates with the other portion of the first space and a fourth line which communicates with the inner portion of the second space, said pressurized fluid supply system including valve means for alternatively pressurizing and venting the other portion of the first space and the inner portion of the second space so as to cause said rod to reciprocate longitudinally; and a guide element mounted in said lower chamber for supporting said second bellows during the alternating pressurizing and venting thereof.

2. A pump as set forth in 1, wherein said first line connects to a port in said upper wall of the upper chamber and said second line connects to a port in said upper wall of the lower chamber.

3. A pump as set forth in claim 1, wherein said guide element includes a cylindrical element fixed to the upper wall of the lower chamber, said cylindrical element being disposed within said inner portion of the second space in concentric relationship to said piston rod and said second bellows.

4. A pump as set forth in claim 3, wherein said guide element comprises a support ring.

5. A pump as set forth in claim 3, wherein said cylindrical element has a vertical extending slot therein.

6. A pump as set forth in claim 2, wherein said one of the walls of the upper chamber is the lower wall thereof.

7. A pump as set forth in claim 6, wherein a bore hole system is drilled in said piston rod for communicating said third line with the inner portion of the upper chamber.

8. A pump as set forth in claim 2, wherein said one of the walls of the upper chamber is the upper wall thereof.

9. A pump as set forth in claim 1, wherein is included an elongated cylindrical member disposed in surrounding relationship to said piston rod and interconnecting the lower wall of the upper chamber and the upper wall of the lower chamber.

10. A pump as set forth in claim 7, wherein a first seal is provided in the upper wall of the lower chamber and a second seal is provided in the lower wall of the upper chamber, said seals being located inside said elongated cylindrical member, said piston rod extending through said seals.

* * * * *